US006047465A

United States Patent [19]

Kizu et al.

[11] Patent Number: 6,047,465

[45] Date of Patent: Apr. 11, 2000

[54] ATTACHING DEVICE OF CONNECTING RING TO PULL TAB FOR SLIDE FASTENER SLIDER

[75] Inventors: Yasutaka Kizu; Tatsumi Shirodera, both of Toyama-ken, Japan

[73] Assignee: YKK Corporation, Tokyo, Japan

[21] Appl. No.: 09/327,908

[22] Filed: Jun. 8, 1999

[30] Foreign Application Priority Data

Jun. 23, 1998 [JP] Japan ..... 10-213395

[51] Int. Cl.[7] ..... A41H 37/06

[52] U.S. Cl. ..... 29/766; 29/409

[58] Field of Search ..... 29/766, 408, 409, 29/33.2

[56] References Cited

U.S. PATENT DOCUMENTS 5,024,544 6/1991 Yoneda et al. ..... 29/766
5,067,221 11/1991 Oyama et al. ..... 29/766
5,174,017 12/1992 Hatagishi ..... 29/766
5,426,840 6/1995 Funaya ..... 29/766
5,426,848 6/1995 Shibata et al. ..... 29/766

*Primary Examiner*—P. W. Echols
*Attorney, Agent, or Firm*—Hill & Simpson

[57] ABSTRACT

The present invention provides an attaching device of a connecting ring to a pull tab for a slide fastener slider for attaching a connecting ring to a pull tab at a high speed. In the attaching device of a connecting ring to a pull tab for a slide fastener slider, a guide body having a guide groove for supplying a connecting ring while regulating an attitude of the connecting ring to be supplied is mounted on the supply belt. One connecting ring is supplied from a forward end of the supply belt by a connecting ring feed member. The supplied connecting ring is inserted into and received by a connecting ring accommodating recessed portion which is provided at a bottom portion of the connecting ring retainer and retains the connecting ring while regulating an attitude of the connecting ring to be attached. The connecting ring retainer moves down to attach the connecting ring to a connecting portion of the pull tab which has been carried by a rotary table.

5 Claims, 7 Drawing Sheets

ATTACHING DEVICE OF CONNECTING RING TO PULL TAB FOR SLIDE FASTENER SLIDER

BACKGROUND OF THE INVENTION

1. Field of the Invention

The present invention relates to an attaching device of a connecting ring to a pull tab to be mounted to a slide fastener slider.

2. Description of the Related Art

In a conventional attaching device of a connecting ring of a pull tab, a chute to which a large number of connecting rings are accumulated is mounted above a carriage passage of pull tabs and one connecting ring is dropped from a lower end of the chute to a connecting portion of a pull tab so as to attach the connecting ring to the pull tab. Or, a supply conveyer is used instead of the chute, one connecting ring is supplied to a connecting portion of a pull tab from a forward end of the conveyer so as to attach the connecting ring to the pull tab, and the pull tabs are carried to an attaching position of the connecting ring by reciprocating pawls.

In the conventional attaching device of the connecting ring of the pull tab, because an attitude for attaching of the connecting ring is not firmly maintained in an accurate state when the connecting ring is attached to the connecting portion of the pull tab, an attitude of the connecting ring to be supplied to the connecting portion of the pull tab is unstable. Therefore, it has been difficult to increase a speed of attachment of the connecting ring.

SUMMARY OF THE INVENTION

It is an object of the present invention to provide an attaching device of a connecting ring to a pull tab for a slide fastener slider wherein the conventional problems are solved, attitudes of a connecting ring to be supplied and attached are regulated, and the connecting ring is retained reliably so as to stabilize supply of the connecting ring to a connecting portion of the pull tab, thereby attachment of the connecting ring can be carried out at a high speed.

To achieve the above object, according to the invention, there is provided an attaching device of a connecting ring of a pull tab of a slide fastener slider comprising a connecting ring supply portion 1 having a supply belt 4 including guide groove 5 and guide body 6 for regulating attitudes (orientations) of connecting rings 2 to be supplied, a connecting ring attaching portion 20 having a connecting ring retainer 24 for receiving and retaining each connecting ring 2 supplied while regulating an attitude (orientation) of the connecting ring 2 to be attached, and a pull tab carriage portion 40 for carrying a pull tab 22 whose connecting portion 23 is attached with the connecting ring 2, to below the connecting ring retainer 24.

Because the connecting ring attaching portion 20 has the connecting ring retainer 24 for carrying the connecting ring 2 to the connecting ring accommodating recessed portion 28 while maintaining the providing attitude of the supplied connecting ring 2 from the connecting ring supply portion 1, the connecting ring 2 can be attached without disarranging the attitude thereof to be attached even if the connecting ring attaching device is operated at a high speed.

Because the connecting ring supply portion 1 has a connecting ring feed member 8 including a pawl 9 to be engaged with a hole portion 14 of the connecting ring 2 in a guide groove 5 and to supply the connecting rings 2 one by one, the connecting ring 2 can be reliably fed in the proper attitude.

Because the connecting ring retainer 24 of the connecting ring attaching portion 20 is provided at a bottom portion thereof with a connecting ring accommodating recessed portion 28 having exchangeably accommodated positioning piece 31 for regulating the attitude to be attached and retaining the connecting ring 2, thus the connecting ring 2 can be reliably attached in the proper attitude.

Because the pull tab carriage portion 40 has a rotary table 41 provided at a peripheral end portion thereof with a plurality of notch portions 42 each for resiliently clamping the pull tab 22 to which the connecting ring 2 is to be attached, the pull tab can be reliably carried at a high speed.

DESCRIPTION OF THE PREFERRED EMBODIMENT

Figure 1:
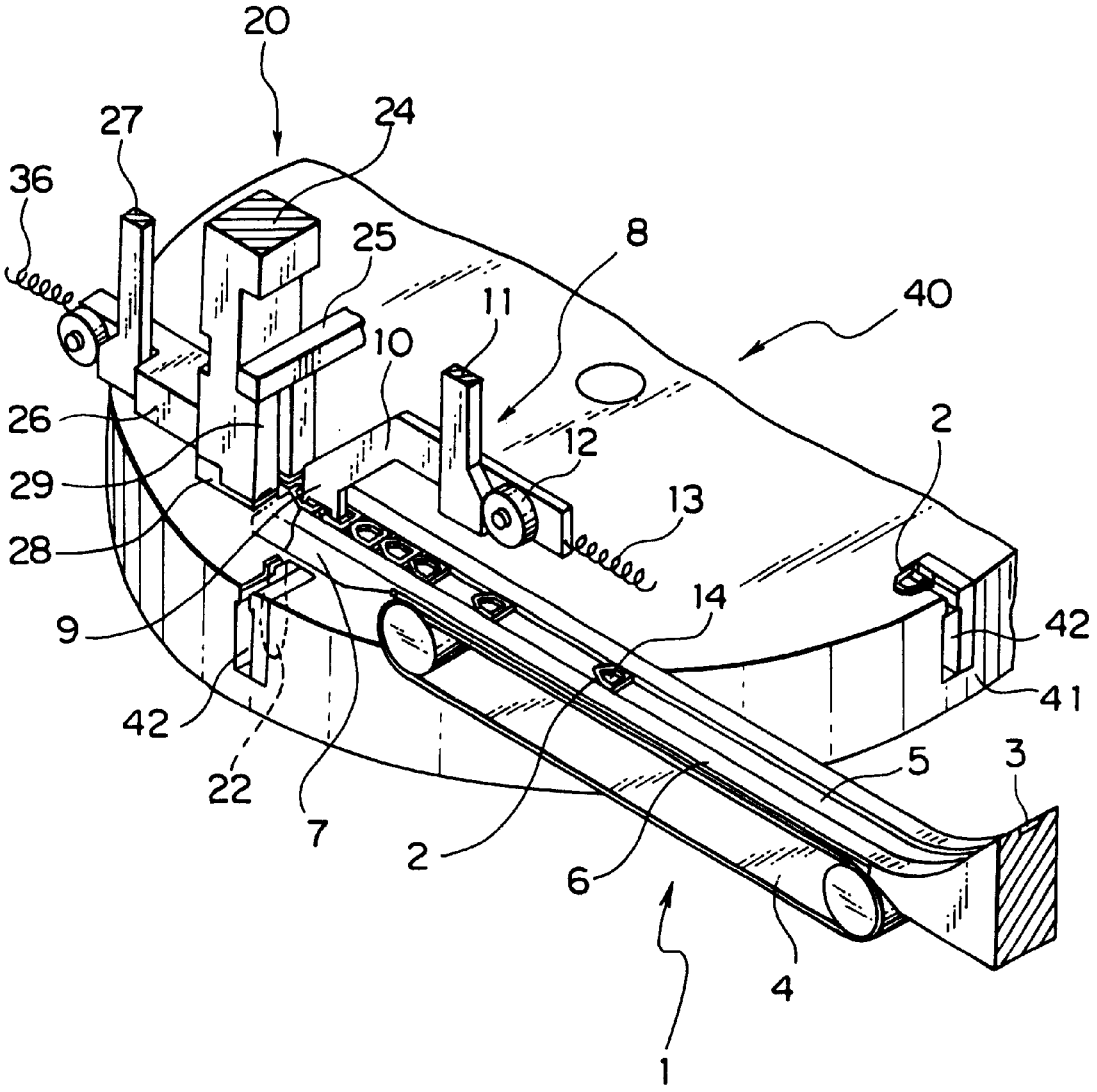
FIG. 1 is a schematic perspective view of a connecting ring attaching device of the present invention.

An embodiment of the present invention will be described below based on an example shown in the drawings.

FIG. 1 shows an attaching device of a connecting ring to a pull tab of the invention. FIGS. 3 to 7 show states of the connecting ring to be attached to the pull tab by the attaching device of a connecting ring to a pull tab in the order of operations.

Figure 8:
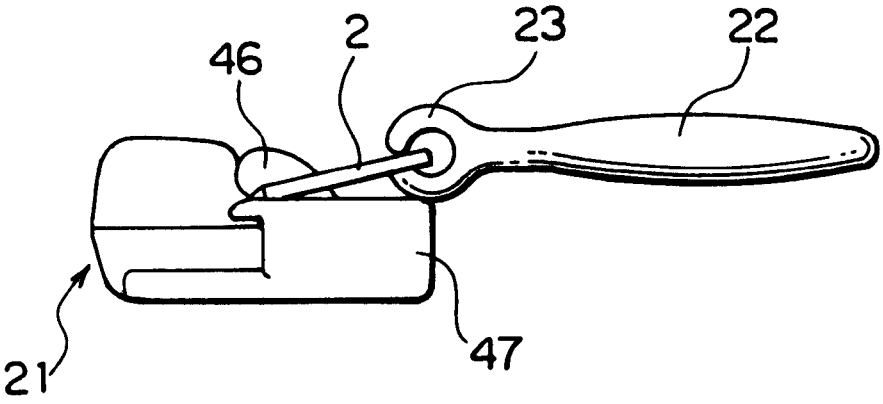
FIG. 8 is a side view of a slider assembled by mounting the connecting ring attached to a pull tab to the slider.
Figure 9:
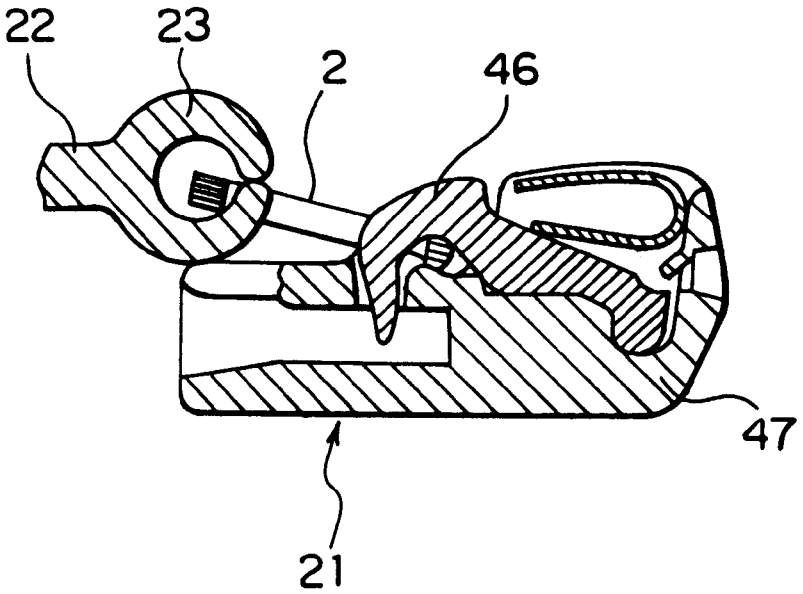
FIG. 9 is a sectional view of an essential portion of the slider.

The embodiment shown in the drawings is a connecting ring attaching device for attaching a connecting ring 2 to a pull tab 22 used for a hidden type of slide fastener slider 21 shown in FIGS. 8 and 9, but the invention can be applied to an attaching device of a connecting ring to a pull tab used for a normal type of slide fastener slider.

The attaching device of a connecting ring to a pull tab 22 of the invention comprises a connecting ring supply portion 1, connecting ring attaching portion 20, and a pull tab carriage portion 40. The connecting ring supply portion 1 supplies connecting rings 2 to the connecting ring attaching portion 20 one by one while maintaining a proper attitude of each connecting ring 2. The connecting ring 2 is dropped and supplied onto a supply belt 4 through a chute 3 from a hopper or the like (not shown) accommodating a large number of connecting rings 2. As shown in FIG. 1, a guide body 6 having a guide groove 5 with a slightly larger width than the connecting ring 2 is mounted on the supply belt 4 with a gap maintained between the guide body 6 and the supply belt 4. Being regulated by the guide groove 5 to be in proper attitudes, the connecting rings are supplied forward by the supply belt 4. At a forward end of the supply belt 4, a guide plate 7 is fixed to close a bottom portion of the guide groove 5 of the guide body 6 and to arrange the connecting rings 2 supplied by the supply belt 4 in the guide groove 5 on the guide plate 7 in order in proper attitudes. A connecting ring feed member 8 is mounted above the guide plate 7 so as to feed the connecting rings 2 to the connecting ring attaching portion 20 one by one.

Figure 3:
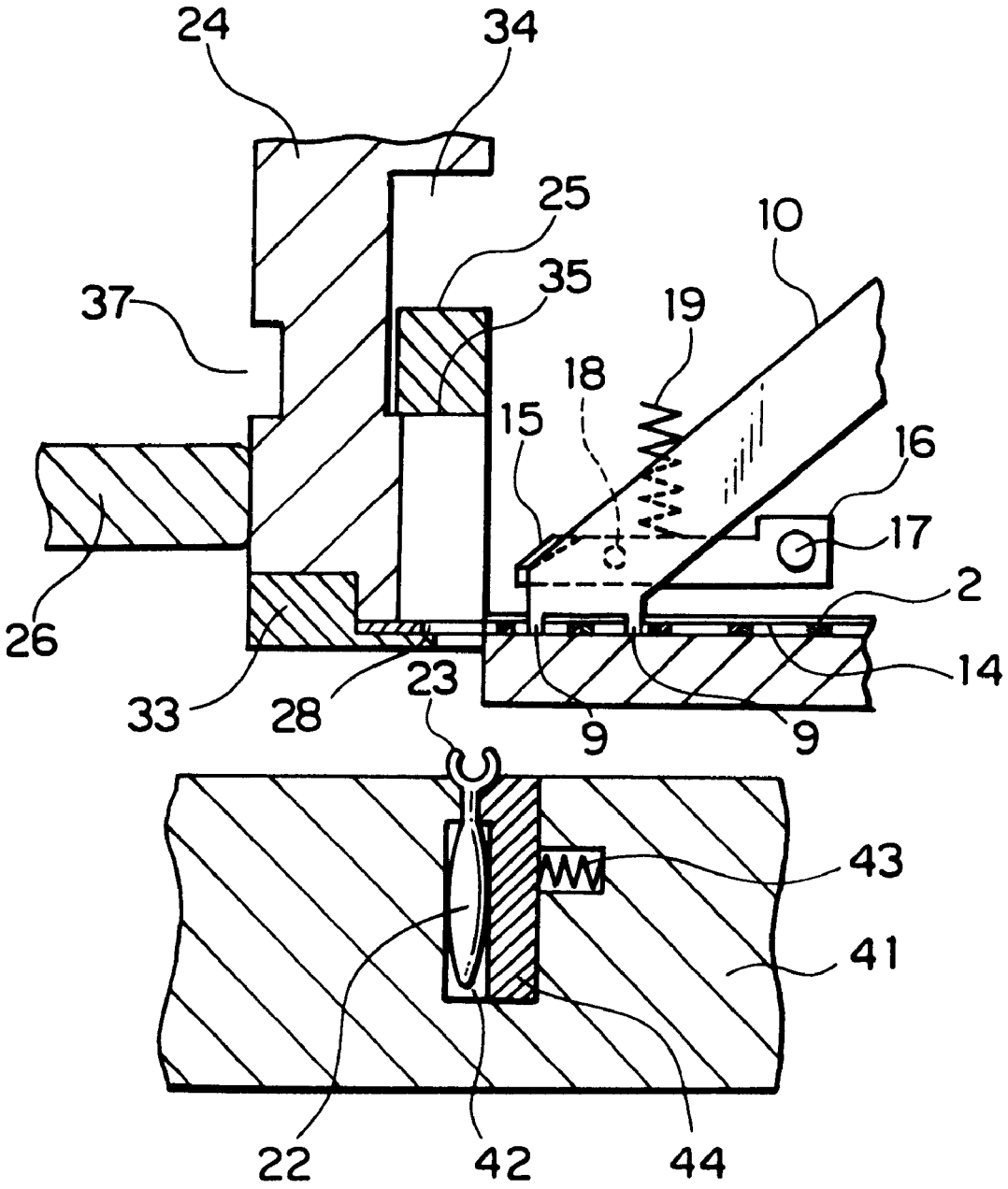
FIG. 3 is a sectional view of an essential portion before supplying a connecting ring to a connecting ring attaching portion.
Figure 4:
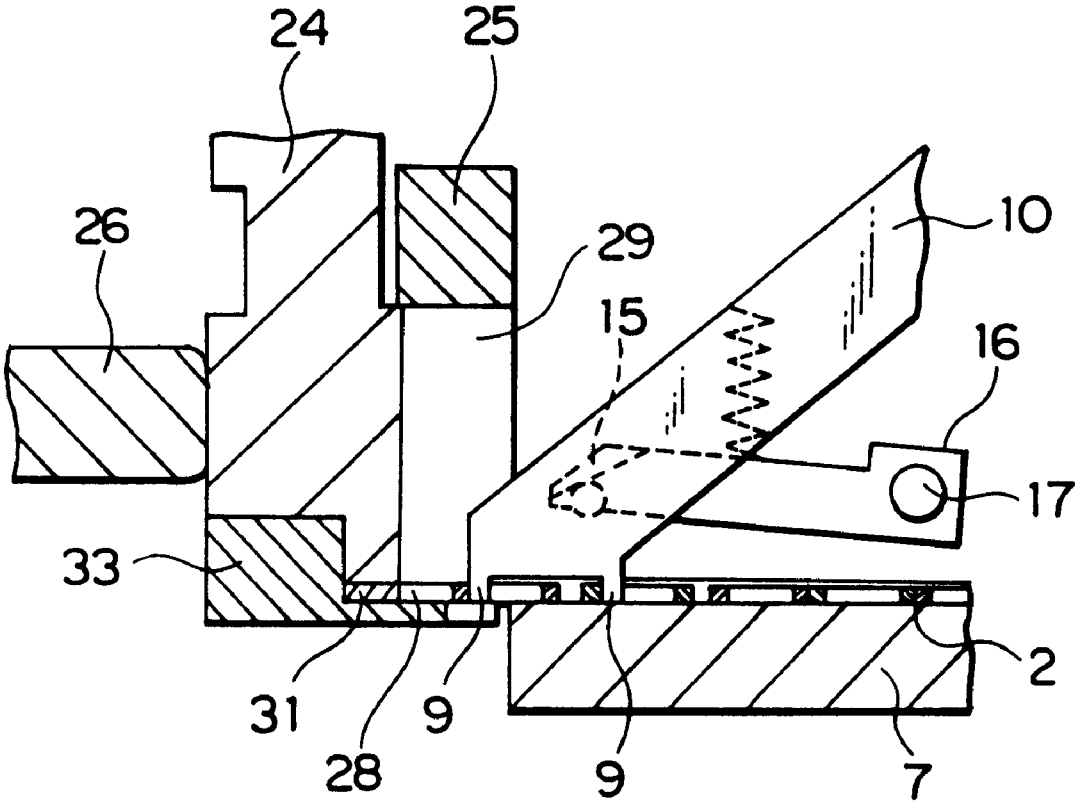
FIG. 4 is a sectional view of the essential portion while supplying.
Figure 5:
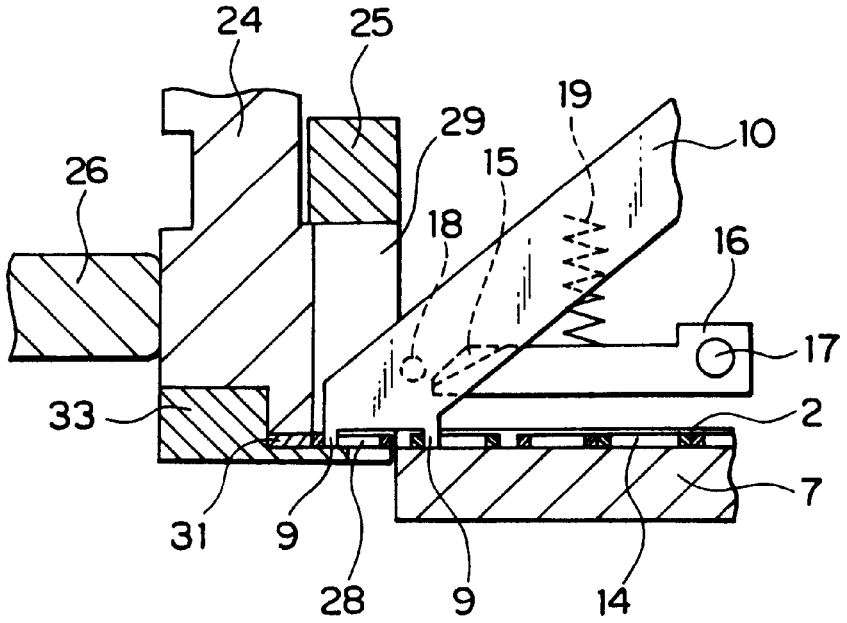
FIG. 5 is a sectional view of the essential portion when the supply is completed.
Figure 6:
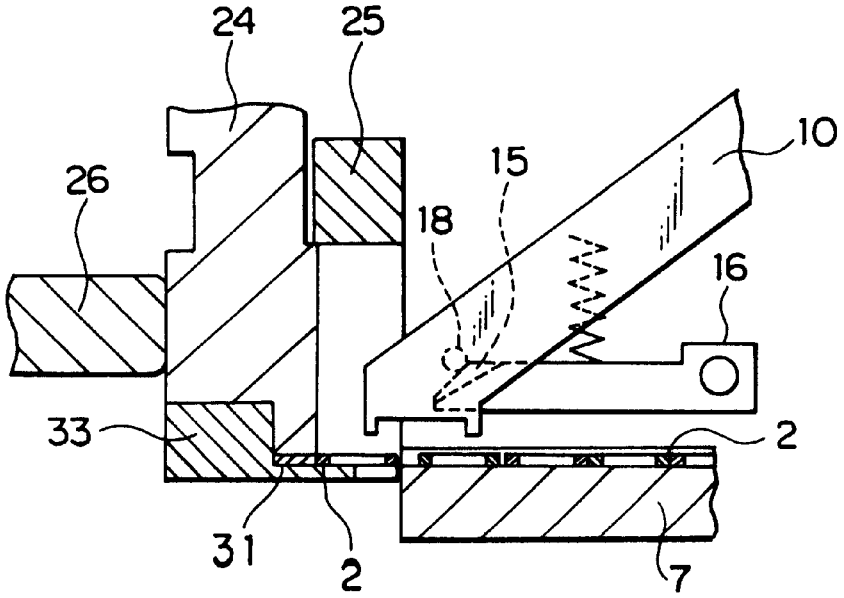
FIG. 6 is a sectional view of the essential portion when the supply is completed and an operating lever recedes.
Figure 7:
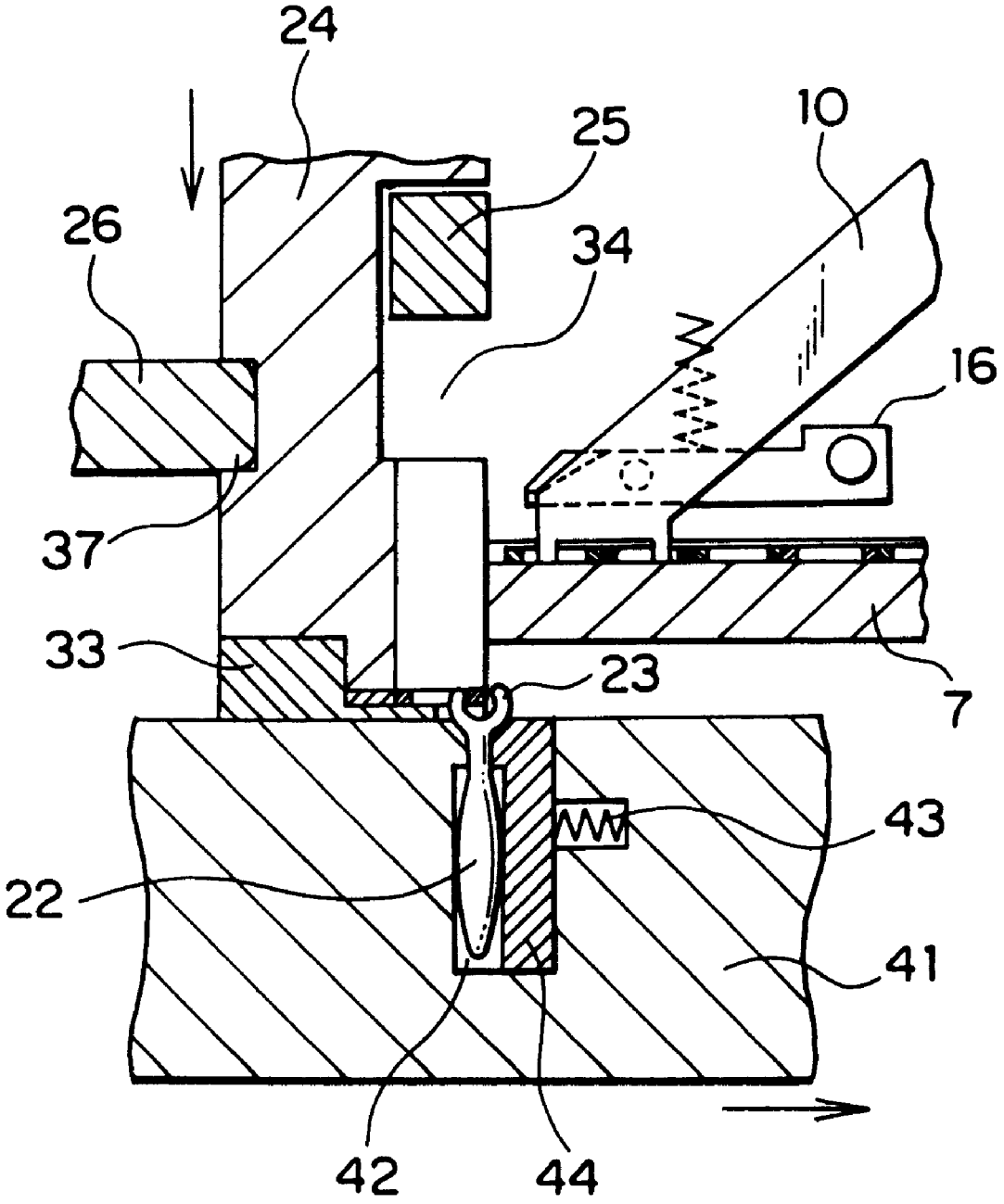
FIG. 7 is a sectional view of the essential portion in attaching of the connecting ring.

The connecting ring feed member 8 comprises an operating lever 10 defined at a lower portion of a tip end thereof with two pawls 9, 9 and a cam 11 for reciprocating the operating lever 10 and operates as shown in FIGS. 3 to 7 to intermittently supply the connecting rings 2 to the connecting ring attaching portion 20 one by one. A rotary roll 12 is mounted to a side of the operating lever 10 and is pressed against the cam 11 by pressing the operating lever 10 with a compression spring 13. The cam 11 has a larger width at its lower end portion and a smaller width at its upper portion as shown in FIG. 1 and reciprocates upward and downward thereby the operating lever 10 moves forward and rearward. The two pawls 9, 9 are defined at the lower portion of the tip end of the operating lever 10, the respective pawls 9, 9 are inserted into hole portions 14, 14 of forward and rear connecting rings 2, 2 as shown in FIG. 3, and the connecting rings 2, 2 move toward the connecting ring attaching portion 20 by a distance corresponding to a length of one connecting ring 2 by the forward movement of the operating lever 10 as shown in FIGS. 4 and 5, thereby supplying the front connecting ring 2 into a connecting ring accommodating recessed portion 28. At a side portion of the operating lever 10, an orbit guide lever 16 provided at a side of a tip end thereof with a projecting inclined plate 15 is supported by a compression spring 19 as shown in FIG. 3 such that the tip end portion of the orbit guide lever 16 moves up and down about a support shaft 17 at a base portion of the orbit guide lever 16. The inclined plate 15 at the tip end of the orbit guide lever 16 is engaged with a projection 18 provided on a side face of the operating lever 10 when the operating lever 10 moves forward and rearward. When the operating lever 10 moves forward, the operating lever 10 is pushed down such that the operating lever 10 can reliably hold the supplied connecting rings 2 as shown in FIG. 4. When the operating lever 10 moves rearward, the operating lever 10 is pushed up such that the pawls 9 can be reliably detached from the hole portions 14 of the connecting rings 2 and the operating lever 10 can move rearward as shown in FIG. 6. Then, the operating lever 10 which has moved rearward moves down by detaching the projection 18 from the inclined plate 15 and the pawls 9, 9 are inserted into hole portions 14, 14 of next supplied connecting rings 2, 2 such that the operating lever 10 is prepared for the next supply as shown in FIG. 7. Such operations are repeated, thereby supplying the connecting rings 2 to the connecting ring attaching portion 20 while maintaining the connecting rings 2 in the proper attitudes.

The connecting ring attaching portion 20 is for attaching the connecting ring 2 supplied from the connecting ring supply portion 1 to a connecting portion 23 of the pull tab 22 which has been carried, and it comprises a connecting ring retainer 24, two stoppers 25 and 26, and a cam 27.

Figure 2:
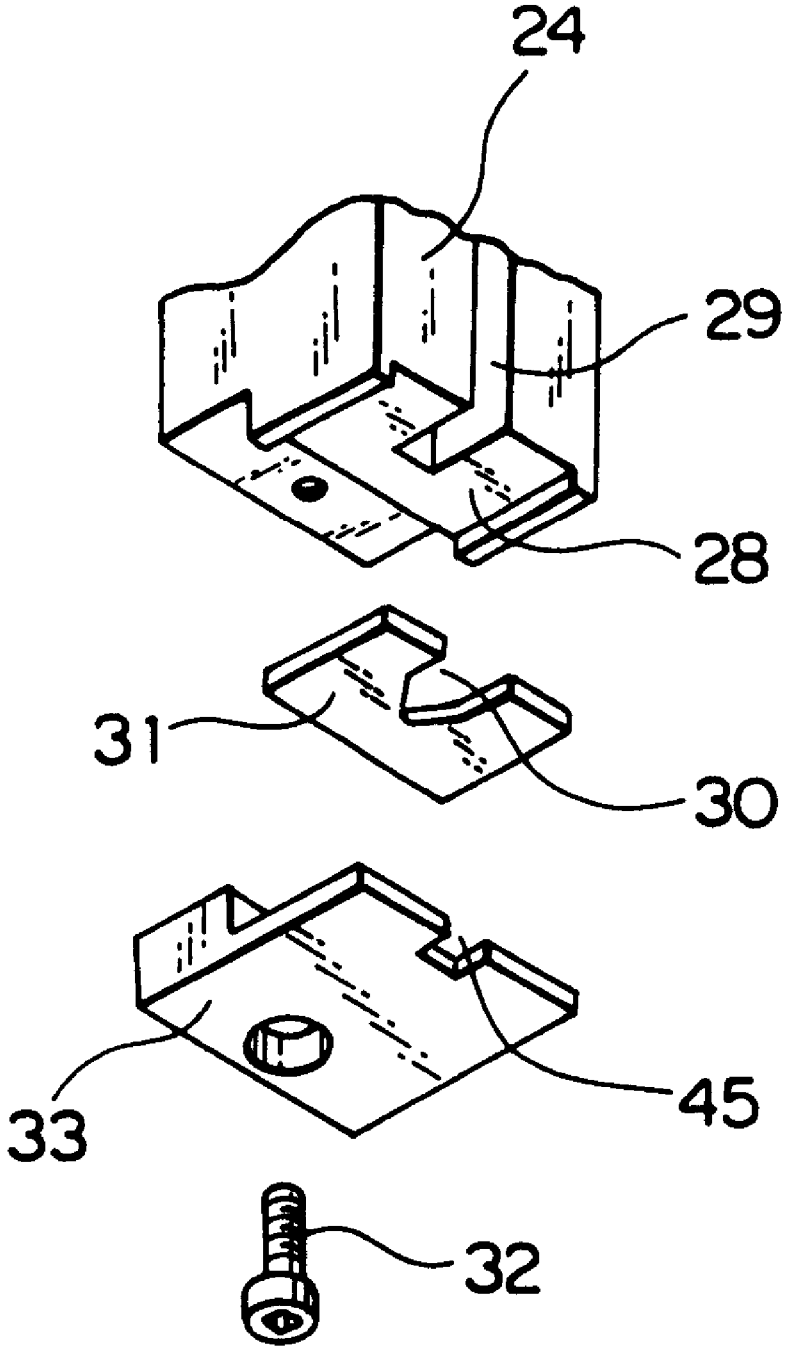
FIG. 2 is an exploded perspective view of parts attached to a bottom portion of a connecting ring retainer.

The connecting ring retainer 24 is on an extension of the supply belt 4 and reciprocates upward and downward by a driving device (not shown) so as to attach the connecting ring 2 to the pull tab 22 which has been carried at a position below the connecting ring retainer 24. As shown in FIG. 2, the connecting ring retainer 24 is formed at a bottom portion thereof with the connecting ring accommodating recessed portion 28. A groove portion 29 is defined in a side face of the connecting ring retainer 24 in a vertical direction, the side face facing the guide plate 7 on a supply side. A tip end of the operating lever 10 which has carried the connecting ring 2 into the connecting ring accommodating recessed portion 28 enters the groove portion 29 as shown in FIG. 5, thereby reliably supplying the connecting ring 2. As shown in FIG. 2, a positioning piece 31 defined with a notch portion 30 in the same shape as a tip end of the connecting ring 2 is fitted into the connecting ring accommodating recessed portion 28 so as to receive the supplied connecting ring 2 in the proper attitude and to attach the connecting ring 2. The positioning piece 31 fitted into the connecting ring accommodating recessed portion 28 is exchangeably supported by a support piece 33 fixed by a screw 32 from below as shown in FIG. 2.

The connecting ring retainer 24 is mounted at left and right sides thereof with the two stoppers 25 and 26 so as to receive and attach the connecting ring 2 in the proper position. On a side of the connecting ring supply portion 1, the stopper 25 for determining an upward stop position of the connecting ring retainer 24 is mounted and fitted into a notch portion 34 defined in a side face of the connecting ring retainer 24 so as to abut on a lower step portion 35 of the notch portion 34 when the connecting ring retainer 24 moves up, thereby properly stopping an entrance of the connecting ring accommodating recessed portion 28 of the connecting ring retainer 24 at a supply position of the connecting ring 2. On an opposite side to the supply side of the connecting ring 2, the stopper 26 for determining an attaching position of the connecting ring 2 is mounted. The stopper 26 is pushed toward the connecting ring retainer 24 by a compression spring 36 and is pressed against a side face of the cam 27 so as to be reciprocated toward and away from a side face of the connecting ring retainer 24 by upward and downward movements of the cam 27 which is defined at a lower end portion thereof with a projecting portion. In the side face of the connecting ring retainer 24, on the other hand, a notch portion 37 for determining a descending attaching position is defined. As shown in FIG. 7, a tip end of the stopper 26 is fitted into the notch portion 37 so as to stop the connecting ring retainer 24 at a proper attaching position. When the connecting ring 2 has been attached, the stopper 26 is moved rearward by the cam 27 and is detached from the notch portion 37, thereby allowing the connecting ring retainer 24 to move up. The connecting ring retainer 24 moves up to a position for receiving the connecting ring 2 as shown in FIGS. 3 and 4. Such operations are repeated to attach the connecting rings 2.

The pull tab carriage portion 40 comprises a rotary table 41 disposed under the connecting ring attaching portion 20 as shown in FIG. 1. A large number of notch portions 42 are formed at a peripheral end portion of the rotary table 41 so as to clamp the pull tabs 22 to which the connecting rings 2 are attached. The rotary table 41 is rotated by a driving device (not shown), thereby carrying the pull tabs 22 to a position below the connecting ring retainer 24. The pull tabs 22 to which the connecting rings 2 are attached are supplied to the notch portions 42 at a starting position of the rotary table 41 by a pull tab supply device (not shown). The connecting portion 23 of the pull tab 22 to which the connecting ring 2 has been attached is clamped at a final position of the rotary table 41. Then, the pull tab 22 is attached to a slider 21 by a slider attaching device (not shown). Or, the pull tab 22 is drawn from the notch portion 42 after clamping the connecting portion 23 and is attached to the slider 21 at the next step.

The pull tab 22 supplied to the notch portion 42 of the rotary table 41 is clamped by a clamping piece 44 which is pushed by a compression spring 43 with the connecting portion 23 of the pull tab 22 projecting from a surface of the rotary table 41 as shown in FIG. 7. When the pull tab 22 is carried to below the connecting ring retainer 24, the connecting ring retainer 24 moves down such that an end portion of the connecting ring 2 accommodated in the connecting ring accommodating recessed portion 28 of the connecting ring retainer 24 is fitted into the connecting portion 23. The pull tab 22 moves as the rotary table 41 rotates, thereby drawing the connecting ring 2 from the connecting ring accommodating recessed portion 28. The support piece 33 serving as a lid for the connecting ring accommodating recessed portion 28 is formed with a notch portion 45 as shown in FIG. 2 such that the connecting portion 23 of the pull tab 22 projecting from the surface of the rotary table 41 can be inserted into the hole portion 14 of the connecting ring 2.

The rotary table 41 is used in the carriage portion 40 of the pull tabs, but the pull tabs 22 may be carried along a straight line by using pawls instead of the rotary table 41. In this case, because the attitudes of the connecting rings 2 to be supplied and attached are properly and reliably maintained, the connecting rings 2 can be attached at a high speed.

FIGS. 8 and 9 show a hidden type of slide fastener slider 21 assembled by using the pull tab 22 to which the connecting ring 2 is attached by the device of the first embodiment of the invention. The connecting ring 2 attached to the pull tab 22 is rotably mounted to an upper portion of a body 47 of the slider 21 by a stop claw 46.

The connecting ring attaching device of the invention is the most suitable for attaching the connecting ring to the pull tab for the hidden type of slide fastener slider at a high speed, the connecting ring being small and difficult to maintain the proper attitudes to be supplied and attached, but is not limited to such a use. Even if a size of a connecting ring of a pull tab is normal like for a normal type of slide fastener slider, such a connecting ring can be similarly attached to a pull tab at a high speed.

The invention has the above-described structure, and because the connecting ring is supplied by using the supply belt having the guide for regulating the attitude of the connecting ring to be supplied, the connecting ring which is small and unstable and a supplied attitude thereof is liable to be disarranged can be supplied to the connecting ring attaching portion at a high speed while maintaining the proper attitude of the connecting ring to be supplied. Also, because the supplied connecting ring is received by the connecting ring retainer for retaining the connecting ring while regulating the attitude of the connecting ring to be attached, the connecting ring can be reliably retained in the proper attitude to be attached. Therefore, a mistake in attachment can be prevented and an attaching speed of the connecting ring can be increased. By simultaneously increasing a speed of carriage of pull tab to which the connecting ring is attached, the connecting ring can be efficiently attached to the pull tab, thereby further improving productivity.

Because the connecting ring does not change the attitude from when the connecting ring is supplied until it is attached to the pull tub, the connecting ring can be attached without disarranging the attitude thereof to be attached even if the connecting ring attaching device is operated at a high speed.

Because the connecting ring in the guide groove is supplied by the connecting ring feed member having a pawl to be engaged with the hole portion of the connecting ring and supply a connecting ring one by one, the connecting ring can be reliably supplied at a high speed without disarranging the attitude of the connecting ring to be attached.

Furthermore, because the connecting ring accommodating recessed portion is provided in the bottom portion of the connecting ring retainer and the exchangeable positioning piece for regulating the attitude of the connecting ring to be attached is accommodated in the connecting ring accommodating recessed portion, the connecting ring can be reliably retained in the proper attached attitude. Also, because the positioning piece is exchangeable, positioning of connecting rings in various shapes can be carried out very conveniently. Moreover, because the connecting ring is accommodated in the recessed portion, the connecting ring can be attached without disarranging the attitude thereof to be attached even if the connecting ring retainer is operated at a high speed.

Because the pull tab to which the connecting ring is attached is carried by resiliently clamping the pull tab in the notch portion in the rotary table, the pull tab can be carried smoothly, and a speed of attachment of the connecting ring can be easily increased.

What is claimed:

1. A device for attaching a connecting ring to a pull tab for a slide fastener slider comprising a connecting ring supply portion having a supply belt and guide groove to regulate orientations of connecting rings to be supplied, a connecting ring attaching portion having a connecting ring retainer in a connecting ring receiving position relative to the supply portion, the connecting ring retainer receives and retains the connecting ring supplied from the supply portion, and a pull tab carriage portion positioned adjacent the connecting ring retainer to position the pull tab by the connecting ring retainer.

2. A device for attaching a connecting ring to a pull tab for a slide fastener slider according to claim 1, wherein the connecting ring attaching portion has a connecting ring accommodating recessed portion to maintain the orientation of the supplied connecting ring from the connecting ring supply portion.

3. A device for attaching a connecting ring to a pull tab for a slide fastener slider according to claim 1, wherein the connecting ring supply portion has a connecting ring feed member comprising a pawl to be engaged with a hole portion of the connecting ring in the guide groove and supply the connecting rings one by one to the connecting ring attaching portion.

4. A device for attaching a connecting ring to a pull tab for a slide fastener slider according to claim 1, wherein the connecting ring retainer of the connecting ring attaching portion has a connecting ring accommodating recessed portion at a bottom portion of the connecting ring attaching portion, and a removable connecting ring positioning piece.

5. A device for attaching a connecting ring of a pull tab of a slide fastener slider according to claim 1, wherein the pull tab carriage portion has a rotary table having a plurality of notch portions at a peripheral end portion of the rotary table, each notch portion when in use resiliently clamping the pull tab to which the connecting ring is to be attached.

* * * * *